US005560556A

United States Patent [19]

Claesson et al.

[11] Patent Number: 5,560,556

[45] Date of Patent: Oct. 1, 1996

[54] YARN FEEDER HAVING AN OSCILLATING DAMPING MASS

[75] Inventors: Tore Claesson, Oerby; Morgan Koskelainen, Ulricehamn, both of Sweden

[73] Assignee: Iro AB, Ulricehamn, Sweden

[21] Appl. No.: 199,225

[22] PCT Filed: Aug. 21, 1992

[86] PCT No.: PCT/EP92/01926

§ 371 Date: May 17, 1994

§ 102(e) Date: May 17, 1994

[87] PCT Pub. No.: WO93/03991

PCT Pub. Date: Mar. 4, 1993

[30] Foreign Application Priority Data

Aug. 22, 1991 [DE] Germany ..... 41 27 796.1

[51] Int. Cl.[6] ..... B65H 51/00; D03D 47/36

[52] U.S. Cl. ..... 242/47.01; 139/452

[58] Field of Search ..... 242/47.01, 47.12; 139/450, 452

[56] References Cited

U.S. PATENT DOCUMENTS

| | | | |
|---|---|---|---|
| 4,785,855 | 11/1988 | Benz et al. | 139/452 |
| 4,926,912 | 5/1990 | Zenoni | 242/47.01 X |
| 5,294,067 | 3/1994 | Tholander et al. | 242/47.12 X |
| 5,310,127 | 5/1994 | Deiuri | 242/47.01 |

FOREIGN PATENT DOCUMENTS

| | | | |
|---|---|---|---|
| 3938646 | 5/1991 | Germany | 242/47.01 |
| 439161 | 12/1967 | Sweden . | |

*Primary Examiner*—Michael R. Mansen

*Attorney, Agent, or Firm*—Flynn, Thiel, Boutell & Tanis, P.C.

[57] ABSTRACT

In a thread regulating wheel (F), a storage body (B) is rotatably mounted on a shaft (1) that can be rotated in a housing, and mutually oriented holding magnets (8, 9) mounted in the housing (G) and on the storage body (B) position the storage body (B). At least one oscillating body (K) movably arranged in relation to the storage body (B), linked by friction (R) thereto, is associated with the storage body (B) and acts as a damping mass (m).

19 Claims, 3 Drawing Sheets

YARN FEEDER HAVING AN OSCILLATING DAMPING MASS

FIELD OF THE INVENTION

The present invention refers to a yarn feeder and, more particularly, to a yarn feeder having a yarn storage body which is rotatably supported by a rotating shaft and is held stationary as the shaft rotates by mutually oriented magnets mounted on the storage body and a housing.

BACKGROUND OF THE INVENTION

In view of the fact that the yarn is supplied to the storage body of a yarn feeder from one side, is deposited in turns on said storage body and is then, in most cases overhead and in a circulatory movement, removed on the other side, the storage body must be supported rotatably on the drive shaft of a yarn winding member and it must be prevented in a contactless manner from rotating together therewith. An eccentric weight provided on the storage body and acting through the force of gravity can, for example, be used as a means for preventing the storage body from rotating. In practice, however, the measure of arranging mutually oriented holding magnets in the housing and in the storage body has become generally accepted, said holding magnets guaranteeing, thanks to magnetic forces, that the storage body is prevented from rotating. The holding magnets have, however, the disadvantage that the smallest force preventing the storage body from rotating will occur when the holding magnets are fully aligned with each other, whereas said force will increase progressively in response to a relative rotational displacement of the storage body. Within the large speed range of the drive shaft, resonance phenomena will occur, and these resonance phenomena will result in rotary oscillation movements of the storage body about the axis of the shaft. These oscillation movements are extremely disadvantageous when the machine is in operation, especially if the amplitude at the external circumference touched by the turns of the yarn increases to 1.5 mm or to an even higher value.

There is the risk that the turns will no longer be transported properly to the unwinding side, that sensors directed onto the turns will not respond in an adequate manner and that heavy wear and damage will result from the forces of gravity. In the case of socalled measuring weft feeders comprising at least one stopping device which acts on the storage body by means of a stopping element at certain intervals for blocking then drawing off of the yarn, the rotary oscillation movements will result in detrimental forces acting on the stopping element. Moreover, the response behaviour of a yarn sensor, which is integrated in the stopping device in most cases, will be impaired by said rotary oscillation movements. Finally, in the case of yarn feeders operating according to the socalled yarn separation principle, the mass of the storage body is comparatively big because of the components in the storage body which are required for the yarn separation process, and this will tend to generate large amplitudes of the rotary oscillation movements and, possibly, detrimental forces of gravity. Since a mechanical access to the storage body from the side of the stationary housing for the purpose of supporting the storage body against these oscillation movements is impossible due to the movements of the yarn, it has, up to now, been unavoidable to put up with said oscillation movements.

It is true that, in the case of a measuring weft feeder provided with a wobbling ring which is arranged behind the yarn supply and which is used as an advance element of the storage body, it is known to use the wobbling movement for touching the wobbling ring periodically from outside by means of a pressure bow so as to interfere with the generation of rotary oscillation movements of the storage body. This principle is, however, bound to the use of a wobbling ring.

It is also known to provide the storage body with an extremely small and light structural design and to arrange a very large number of holding magnets also within the storage body for suppressing the rotary oscillations by very high magnetic forces. Extremely small storage bodies will, however, result in problems with respect to the course of the yarn. Moreover, the holding magnets are very expensive.

It is the object of the present invention to provide a yarn feeder of the type mentioned at the beginning in the case of which rotary oscillation movements of the storage body are prevented or at least reduced to a tolerable extent.

In accordance with the present invention, this object is achieved by providing the storage body with an oscillating body which is connected thereto by a damping connection such that the oscillating body is movable relative to the storage body and acts as a damping mass.

In view of the fact that the oscillating body is arranged such that it is movable relative to the storage body and is connected to said storage body via a frictional connection, a rotary oscillation movement of said storage body will excite a movement of said oscillating body, said movement occurring, however, as a phase-displaced movement. Due to the phase-displaced movement of the oscillating body and the frictional connection with the storage body, a consumption of energy will occur between the storage body and the oscillating body, and this consumption of energy will result in an effective damping of the rotary oscillations of the storage body at least down to a tolerable extent, i.e. an externally detectable amplitude of approx. 0.5 mm or less. The oscillating body will damp the rotary oscillations of the storage body although, just as the storage body, it cannot be acted upon mechanically from outside in a direct manner, and although it impairs neither yarn deposition, nor yarn storage nor the unwinding of the yarn.

A sufficient rotary positioning of the storage body can be achieved by a small number of and by comparatively weak holding magnets which constitute only a subordinate factor in the total costs of the yarn feeder. The basic concept of the yarn feeder remains practically unchanged in spite of the integrated damping measures.

In an expedient embodiment, the oscillating body is a solid material with a high specific gravity, such as metal, and is secured coaxially on the storage body so as to permit relative movement of the oscillating body to a limited extent. When a rotary oscillation builds up at the storage body, a phase-displaced rotary oscillation of the oscillating body will occur and result in the desired damping.

Thanks to the high specific gravity of the oscillating body, said oscillating body requires only little space for causing effective damping, and, taking into account the limited space conditions within a yarn feeder, this is extremely important. The centered arrangement of the oscillating body avoids undesirable eccentric forces. The fact that the oscillating body is secured in position guarantees that it cannot separate from the storage body.

In an additional expedient embodiment, the oscillating body is a one-piece component disposed on the end face of the storage body facing a winding member in the interspace therebetween. At least one magnet is secured to the end face in an oscillating body recess. The oscillating body utilizes in an advantageous manner the small interspace, which is available anyhow, for accommodating the holding magnet on the storage body. Hence, no fundamental change in the structural concept of yarn feeders which have already proved to be useful is necessary. Furthermore, yarn feeders which have already been in operation can be converted subsequently by inserting an adequately adapted oscillating body. Especially for yarn feeders having no wobbling ring as an advance element, but having other types of advancing drives or working perhaps even with yarn separation, the oscillating body is a simple, economy-priced and optimum solution of the rotary oscillation problem.

In the case of the embodiment wherein a soft-iron carrier is used to position a holding magnet, the oscillating body is placed in the interspace which is necessary due to the arrangement of the holding magnet, said holding magnet being positioned within a recess of the oscillating body. Additionally, a rotary coupling prevents the oscillating body from rotating on the storage body. The rotary coupling operating with a certain amount of rotational play guarantees that the oscillating body will not strike the holding magnet and be deprived of its damping function. A feature which is advantageous from the structural point of view is the use of the soft-iron carrier for securing the oscillating body in position, the provision of said soft-iron carrier being necessary for fixing the holding magnet anyhow.

In the case of the embodiment wherein the rotary coupling includes a projectionlike engagement member which cooperates with a recess in the oscillating body, the rotary coupling forms an elastic rotation-prevention means for the oscillating body for suppressing impactlike contact between the storage body and the oscillating body on the one hand and for guaranteeing the rotational play of the oscillating body, which is necessary for damping the rotary oscillations, on the other. The engagement member, which may be constructed as a bending spring arm, serves so to speak as an emergency stop in case the oscillating body should become excessively displaced from the position constituting the desired oscillation damping position. As far as oscillation damping is concerned, the rotary coupling does not fulfil any direct function.

A simple embodiment, in the case of which an effective frictional connection is provided between the oscillating body and the storage body, the oscillating body includes a central bushing slidably fitted on a bearing by which the storage body is supported on the shaft. It is, however, just as well imaginable to provide between the oscillating body and the storage body additional areas of contact. Finally, the sliding fit on the bearing reception means of the storage body also guarantees a desirable centering of the oscillating body relative to the axis of the drive shaft.

In the case of the embodiment wherein the oscillating body contacts the storage body, energy consumption in the oscillation damping process is achieved by mechanical sliding friction. It would, however, be just as well imaginable to use rolling friction or other types of friction so as to achieve energy consumption in these areas.

In view of the fact that the friction occurring in the oscillation damping process is causally responsible for oscillation damping, providing a friction lining, which is adjustable and/or replaceable in the area of mutual contact between the oscillating body and the storage body offers the possibility of guaranteeing a desired and/or uniform friction from the very beginning. If necessary, the friction conditions can also be changed subsequently for adjusting the damping effect so to speak purposefully to the yarn feeder speed range causing the strongest rotary oscillations.

A particularly effective damping of the rotary oscillations of the storage body is obtained by making the damping mass proximate the mass of the storage body plus any insert members mounted thereon, even in cases in which said storage body is equipped with additional components required for yarn separation. However, in view of the fact that the damping effect achieved also depends on structural features, viz. on the radius of inertia of the oscillating body, on the distribution of weights within the storage body and/or within the oscillating body, and the like, it may definitely also be expedient to choose the mass of the oscillating body smaller or larger than the mass of the storage body or to distribute the oscillating body to several separate masses.

A very good and fast-responding damping effect is achieved wherein the damping mass corresponds to the storage body mass and preferably is a plastic, if the structural conditions permit the provision of this feature.

The oscillating body need not necessarily be arranged on one axial side of the storage body or the other, but it can just as well be positioned in the interior of the storage body. Also mixed forms are imaginable, in the case of which individual parts of the oscillating body are arranged such that they are distributed in the circumferential direction and also in the axial direction.

An additional advantageous embodiment is disclosed wherein the oscillating body is connected to the storage body by a plastically deformable anti-slip and/or bonding layer having a high internal friction. The anti-slip and/or bonding layer guarantees positioning and centering of the oscillating body on the storage body. Due to the internal friction, said anti-slip layer also has the effect that energy will be consumed during the oscillation damping process. It will be expedient when the anti-slip layer is as inelastic as possible so as to eliminate a spring effect to the best possible degree.

An additional advantageous alternative is disclosed wherein the oscillating body is arranged in a cavity within the storage body. In the case of this alternative, the oscillating body consists of a filling of heavy grains or balls or objects having some other shape, which, when moving relative to the storage body, can consume energy due to friction.

Alternatively, the oscillating body can also consist of a plurality of inserted weights placed in cavities of the storage body or in a separate carrier body for these inserted weights. Said inserted weights can be accommodated in the cavities such that they are freely movable therein.

An additional alternative is disclosed wherein the oscillating body is pendulumlike. The pendulumlike oscillating body consumes energy in its swingtype suspension and, possibly, in frictional contact with the storage body.

In accordance with an additional embodiment where a displaceable or elastically deformable material having a high internal friction is placed within a cavity, the material may be a liquid, paste-like substance, a granulate or a powder. The displaceable or elastically deformable material can be provided as an additional measure improving the damping effect, said displaceable or elastically deformable material opposing an energy-consuming resistance to the relative movement of the oscillating body.

If this material is e.g. a liquid or a pastelike substance, the damping effect can be improved still further by means of the throttle passage, which causes an additional consumption of energy when the material in question passes therethrough.

BRIEF DESCRIPTION OF THE DRAWINGS

On the basis of the drawings, embodiments of the subject matter of the invention are explained.

DETAILED DESCRIPTION

Figure 1:
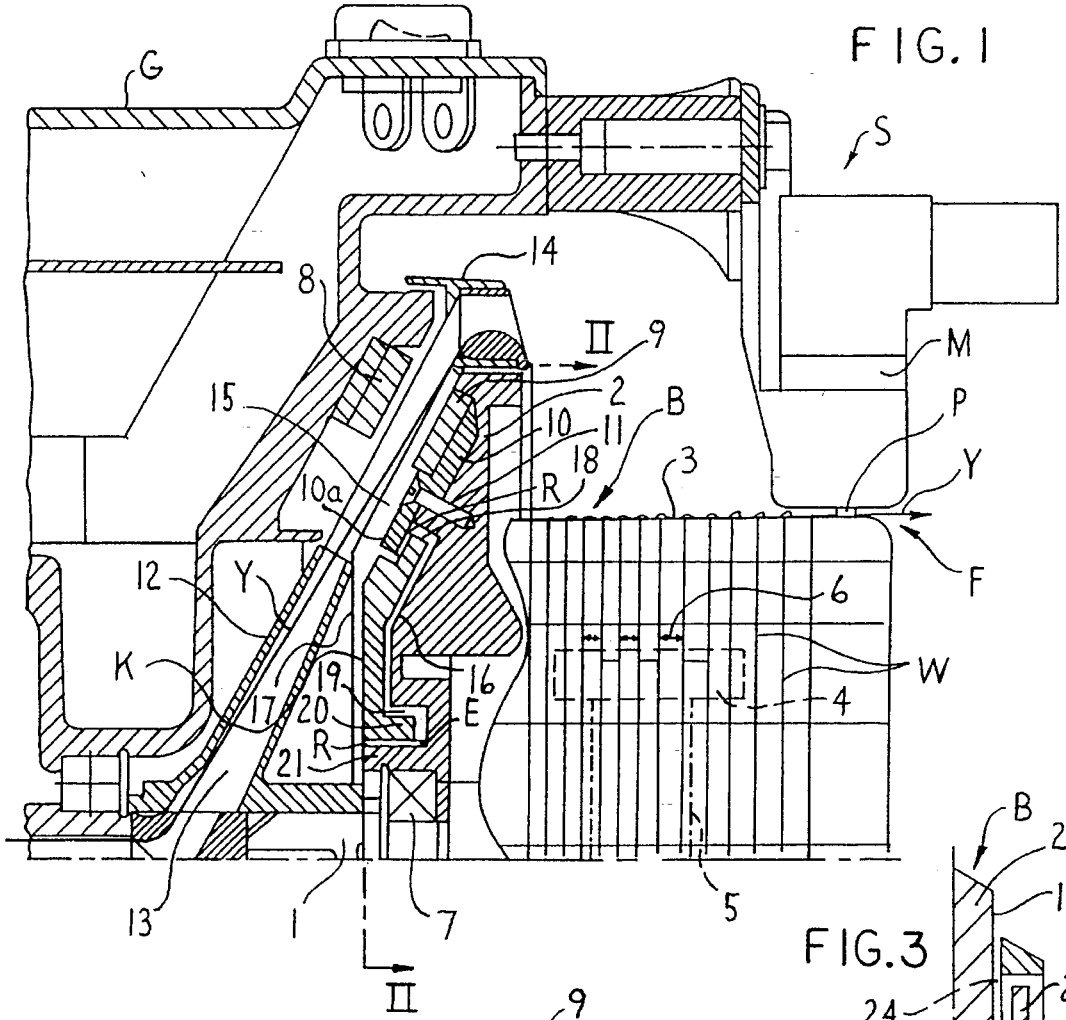
FIG. 1 shows half of a longitudinal section of a yarn feeder.
Figure 3:
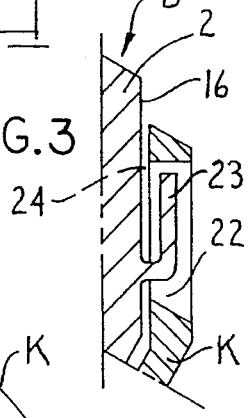
FIG. 3 shows a section in the plane III—III of FIG. 2.
Figure 2:
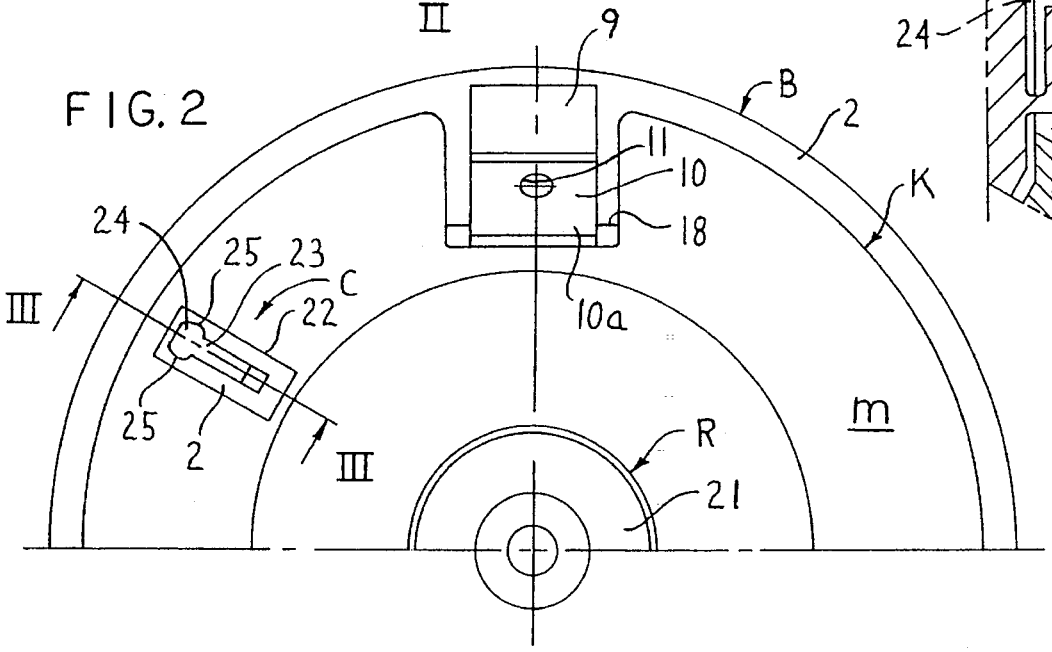
FIG. 2 shows a view in the plane II—II of FIG. 1.

A yarn feeder F according to FIGS. 1 to 3, in particular a measuring weft feeder for a jet loom used for feeding weft yarn sections having an exactly measured length, is provided with a housing G which contains a drive motor (not shown) and which has rotatably supported therein a drive shaft 1 adapted to be driven such that it rotates. A storage body B is rotatably supported on said drive shaft 1 by means of bearings 7, said storage body B comprising a basic body 2 and defining a drumshaped storage surface 3 for turns W of the yarn. The yarn feeder embodiment shown works according to the yarn separation principle, i.e. the turns W deposited on the storage surface 3 are advanced from the left to the right in FIG. 1 and, in the course of this process, they are spaced apart. For the purpose of yarn separation, the storage body B has provided therein insert members 4, 5, e.g. skew and/or eccentric hubs, which are outlined only schematically, said insert members being driven e.g. by the drive shaft 1 and adjusting between the turns W interspaces which are designated by reference numeral 6.

The housing G has connected thereto at least one stopping device S including a stopping element P which is adapted to be moved at certain intervals towards the storage surface 3 from a retracted position into a stopping position by means of an actuator M, e.g. a magnet.

The storage body B, which is rotatably supported on the drive shaft 1, must be supported so as to prevent said storage body B from rotating together with said drive shaft 1. For this purpose, mutually oriented holding magnets 8, 9 are provided in the housing G and on the basic body 2 of the storage body B. Within the housing G, the holding magnets 8 are arranged in an expedient manner such that they are distributed along the whole circumference. On the basic body 2 of the storage body B, however, it will suffice to provide only two diametrically opposed holding magnets 9 or two pairs of such holding magnets. The holding magnets 9 are secured to the basic body 2 by means of soft-iron carriers 10 and holding screws 11. The storage body B consists e.g. of plastic material.

The drive shaft 1, the left part of which is constructed as a hollow shaft, has connected thereto a yarn winding member 12 which is incorporated into a funnel-shaped carrier member 14 and which extends between the holding magnets 8 and 9 to the outside, said yarn winding member 12 being connected to the drive shaft 1 such that it is secured against rotation relative thereto. A yarn guide channel 13 leads through the drive shaft 1 and the winding member 12 to the outside. A yarn Y, which, coming from a supply coil on the left-hand side of FIG. 1, enters the guide channel 13, is deposited in successive turns W on the storage surface 3 by means of the winding member 12 and is then drawn off the storage body B overhead and with a circulating yarn unwinding point by a consumer, e.g. a jet loom (not shown), provided that the stopping element P is in its retracted position. If the stopping element P is in its extended position (FIG. 1), unwinding of the yarn is blocked.

Between the basic body 2 and the circulatory path of the winding member 12, a narrow interspace 15 is provided, in which an oscillating body K is placed, said oscillating body K having the shape of a platelike circular ring disk and being provided with two diametrically opposed recesses 18 in the areas of the holding magnets 9. The oscillating body K consists of a heavy material, preferably metal. It is constructed in an expedient manner as a formed part produced by zinc die-casting or as a turned part consisting of steel and it is adapted to the contour of the end face of the basic body 2, which is designated by reference numeral 16, so that it is located in opposite, contactless relationship with the end face 17 of the winding member 12. The oscillating body K is arranged such that it is adapted to be moved relative to the storage body B and it is secured in position on said storage body B. A frictional connection R exists between the oscillating body K and the storage body B; in the embodiment shown, two frictional connections R are indicated. It is, however, imaginable that the oscillating body K has a plurality of frictional connections with the storage body B. The soft-iron carrier 10 has formed thereon a safety member 10*a* for preventing the oscillating body from slipping off axially, said safety member 10*a* extending beyond the edge of the recess 18 of the oscillating body K, where e.g. a frictional connection R is provided. Furthermore, the basic body 2 is provided with a bearing reception means 21 with the aid of which it is fixed on the bearing 7. Adjacent the bearing reception means 21, a circumferentially extending groove 19 is formed in the basic body 2, the oscillating body K engaging said groove 19 with an annular flange or central bushing 20 which is centered in a sliding fit on the bearing bushing reception means 21 and guided thereon. A frictional connection R is provided between the annular flange 20 and the bearing reception means 21. A friction lining or an adjustable friction element E may be arranged in said frictional connection R.

Furthermore, the oscillating body K is, to a limited extent, prevented from rotating on the basic body 2 by means of a rotary coupling C shown in FIG. 2. The rotary coupling C is formed by a recess 22 in the oscillating body K and by a projectionlike engagement member 23, which is formed on the end face 16 of the basic body 2 and which engages the recess 22. It will be expedient when the engagement member 23 is constructed like a bending spring arm, which is adapted to be bent in the circumferential direction and which is provided with a head 24 of enlarged width located in opposite relationship with the edges of the recess 22 with a certain amount of rotational play 25. The rotary coupling C is not necessary for damping rotary oscillations, but it serves for avoiding excessive rotary displacements between the oscillating body K and the basic body 2 in the course of which the holding magnet 9 and the soft-iron carrier 10 may perhaps come into undesirable contact with the edges of the recesses 18. The oscillating body K represents a damping mass m for the storage body B. It will be expedient when the damping mass m corresponds approximately to the mass of the whole storage body B.

When the yarn feeder F is in operation, the drive shaft 1 is driven within a comparatively wide speed range so that the winding member 12 will rotate and deposit the thread windings W on the storage surface 3. The holding magnets 8, 9 secure the rotary position of the storage body B in relation to the housing G. If, during the rotary movement of the drive shaft 1, the storage body B is excited so that it carries out rotary oscillations, said rotary oscillations will also be transmitted to the oscillating body K via the frictional connections R. The oscillating body K takes up phase-displaced rotary oscillation movements. A consumption of energy takes place via the frictional connections, and this consumption of energy will result in a damping of the rotary oscillations of the storage body B. In the case of a storage body B with yarn separation and with a basic body 2 consisting of plastic material, it has, in practice, been possible to damp by means of a simple oscillating body produced from steel, and without any additional frictional elements E, the rotary oscillations with an amplitude of from 1.5 to 2.0 mm, which occur in a speed range of approx. 1000 rpm, immediately such that the amplitude became smaller than 0.5 mm, and this was sufficient for regular operation. When an adequate fine adjustment of the frictional connections R, among other components, is carried out, a complete damping of the rotary oscillations can be achieved. It is expedient that, for accommodating the oscillating body K, no fundamental structural modifications of the established design principle of such yarn feeders are necessary because the functionally necessary interspace 15 is utilized in an expedient manner for accommodating the oscillating body. The principle of effectively damping the rotary oscillations by means of at least one oscillating body K structurally integrated in the storage body B can be applied in the case of each structural design of a storage body, i.e. also for storage bodies without yarn separation or with a variable diameter or with a different type of mechanical means for advancing the turns of the yarn. Furthermore, the oscillating body may also be arranged within the storage body B or on the end face facing away from the winding member 12.

Figure 4:
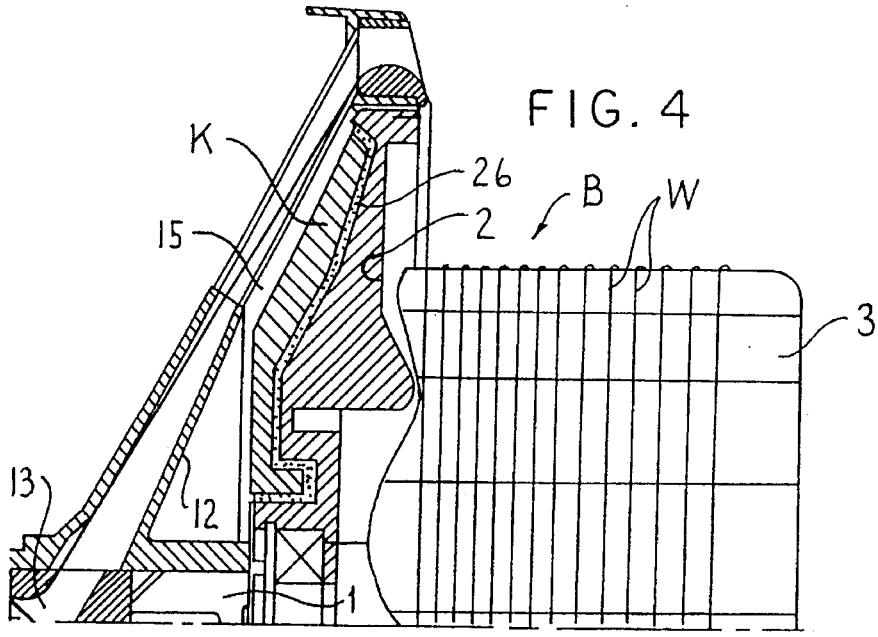
FIG. 4 shows a section, similar to that shown in FIG. 1, of a different emodiment.

In the embodiment according to FIG. 4, the oscillating body K located in the interspace 15 is connected to the basic body 2 of the storage body B by means of an anti-slip and/or bonding layer 26. Measures for securing the oscillating body K in position can thus be dispensed with. The anti-slip layer 26 consists of a material having a high internal friction and the lowest possible spring effect. The oscillating body is, for example, vulcanized on or glued to the basic body 2 by means of an anti-slip layer consisting of rubber or of an elastomer; said anti-slip layer 26 may also extend only over part of the area of the possible radial dimensions of the area of contact between the basic body 2 and the oscillating body K.

Figure 5:
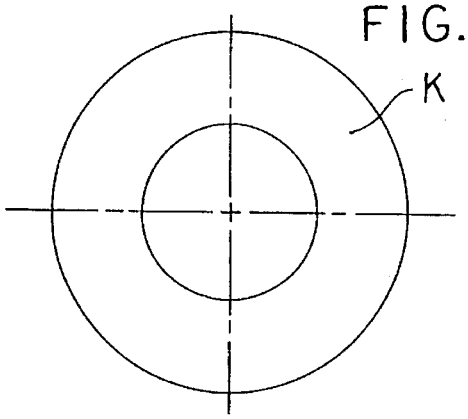
FIG. 5 shows an oscillating body for the embodiment of FIG. 6.
Figure 6:
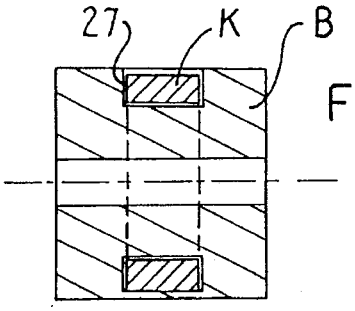
FIG. 6 shows a schematic longitudinal section through an additional embodiment.

FIG. 5 shows clearly an oscillating body which essentially has the shape of a circular ring and which is adapted to be arranged at an arbitrary location in the storage body B, e.g.—as can be seen in FIG. 6—in a central area within a recess 27 of the storage body B.

Figure 7:
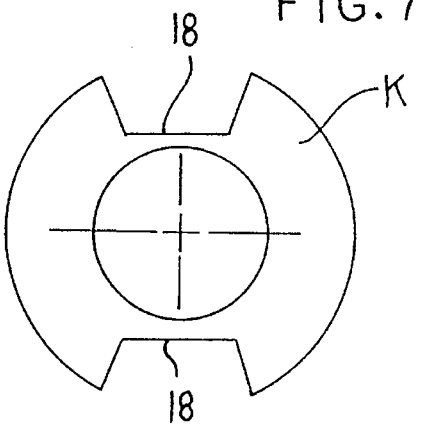
FIG. 7 shows an oscillating body of the embodiments of FIGS. 1 and 4.

FIG. 7 shows clearly a front view of the oscillating body K according to FIGS. 1 and 4 with two diametrically opposed recesses 18 for the holding magnets of the storage body.

Figure 8:
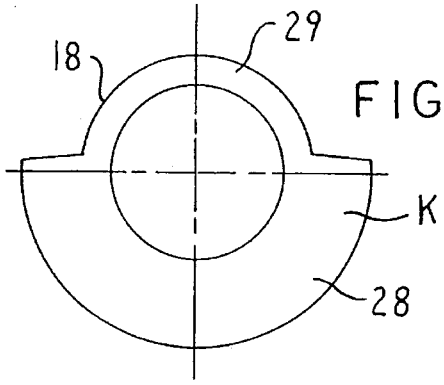
FIG. 8 shows an alternative embodiment for the oscillating body.

FIG. 8 shows cleary a variant of an embodiment of an oscillatingting body K which comprises a lower part 28 of enlarged width and a radially narrow upper part 29 delimiting a recess 18 for the holding magnets which extends continuously over approximately half the circumference.

Figure 9:
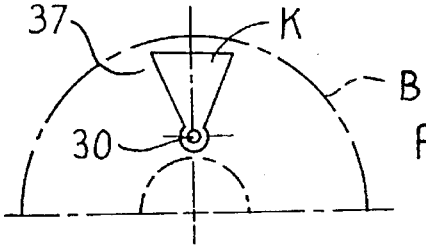
FIG. 9 shows a pendulumlike oscillating body.

According to FIG. 9, at least one oscillating body K, which is constructed as a pendulum, is arranged on the storage body B such that it is adapted to be rotated about a pivot bearing 30. Stop means 31 limit the pendulum motion of the oscillating body K about the pivot bearing 30. Damping is effected either by means of the friction in the pivot bearing 30 or by means of additional frictional connections (not shown) with the storage body B.

Figure 10A:
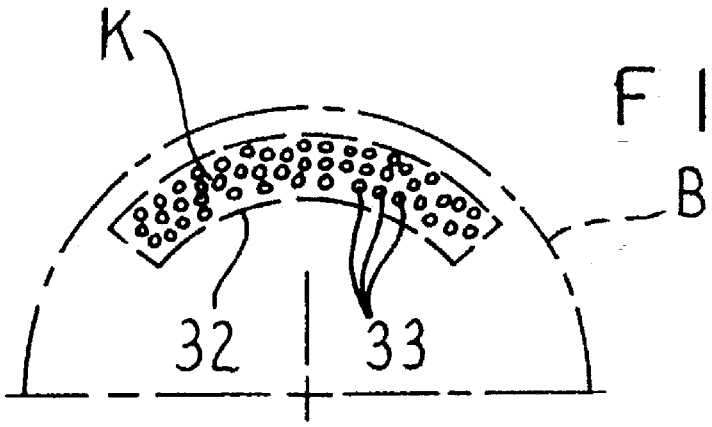
FIG. 10A shows an additional embodiment for the oscillating body.

In the case of the embodiment according to FIG. 10A, the oscillating body K consists of a large number of balls or grains or pellets 33 of heavy material, which are arranged in a cavity 32 of the storage body B. The cavity 32 may additionally be filled with a liquid, a paste or some other material having a high internal friction.

Figure 10B:
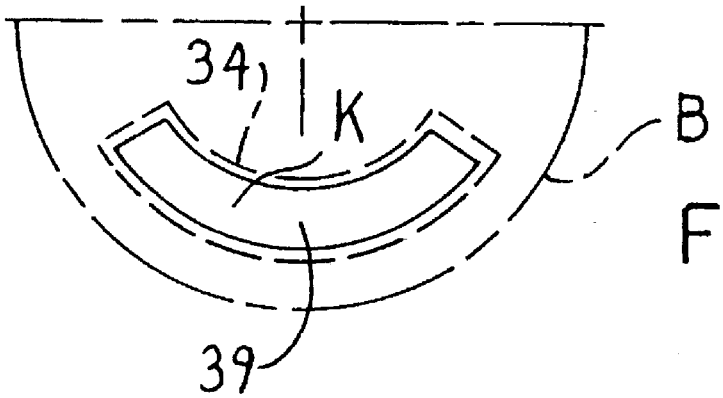
FIG. 10B shows a further embodiment for the oscillating body.

In the case of the embodiment according to FIG. 10B, an oscillating body K, which is constructed as a bow-shaped member 39, is arranged in a pocketlike cavity 34 of the storage body B in a freely movable manner, said oscillating body K being coupled with the storage body B via frictional connections. Several such oscillating bodies K may be distributed over the circumference of and also in the axial direction of the storage body B.

Figure 11:
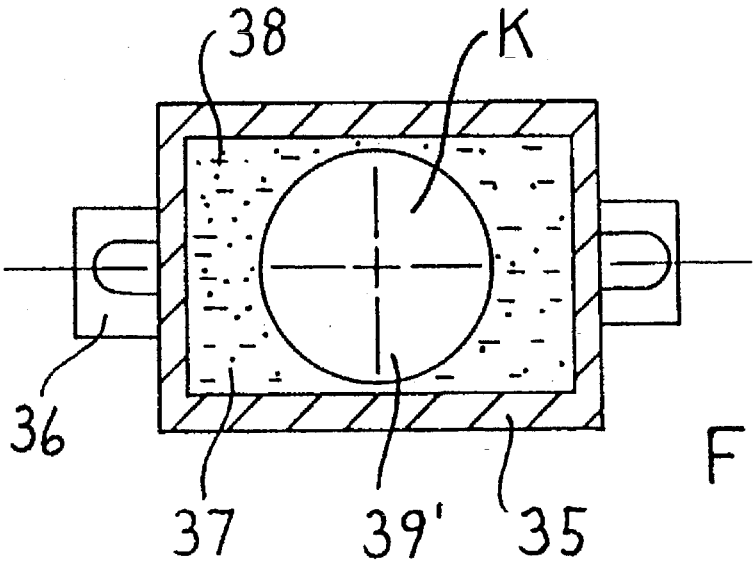
FIG. 11 shows a section through a detail variant.

In the case of the embodiment according to FIG. 11, the oscillating body K is arranged in a receptacle 35 in the cavity 37 thereof and it is constructed as a heavy ball 39 having a high mass. The cavity 37 is filled e.g. with a liquid, a paste or some other deformable medium, which can also be a powder or a granulate. The receptacle 35 can be attached at an adequate location of the storage body with the aid of holding means 36; it will be expedient to attach the receptacle 35 such that, when the rotary oscillations of the storage body start, the oscillating body K will be displaced within the cavity 37 in the longitudinal direction thereof; in the course of this process, it will possibly rub against the walls of the receptacle 35 and/or displace the filling 38 and thus consume energy. Throttle passages are provided between the external circumference of the oscillating body K and the wall of the receptacle 35, and the filling 38 must pass through said throttle passages when the oscillating body K is carrying out its movement, and this will result in an additional consumption of energy.

We claim:

1. A yarn feeder comprising a housing, a shaft which is adapted to be driven within said housing such that said shaft rotates during operation to guide yarn about a rotation axis, a non-rotating storage body for receiving said yarn having support means for rotatably supporting said storage body on said shaft such that said shaft rotates freely with respect to said storage body, mutually oriented holding magnets mounted in said housing and on said storage body so as to position said storage body such that said storage body is prevented from rotating beyond a limited extent about said rotation axis relative to said housing, said storage body having associated therewith at least one oscillating body having a damping mass, said at least one oscillating body being arranged so as to be movable relative to said storage body in response to rotational oscillation of the storage body, a damping connection being provided between said storage body and said at least one oscillating body for damping oscillations of said storage body about said rotation axis by oscillating movement of said at least one oscillating body relative to said storage body about said rotation axis.

2. A yarn feeder according to claim 1, wherein said at least one oscillating body is a solid material having a high specific gravity, said yarn feeder having securing means for securing said at least one oscillating body in position on said storage body, said at least one oscillating body being centered coaxially with said storage body and adapted to be rotated relative to said storage body at least to a limited extent.

3. A yarn feeder according to claim 2, wherein said storage body includes bushing reception means and said at least one oscillating body is provided with a central bushing which is slidably fitted with said bushing reception means of said storage body.

4. A yarn feeder according to claim 1, wherein said at least one oscillating body is a one-piece component and is arranged in an interspace between said storage body and a winding member, which is fixedly connected to said shaft such that said winding member is prevented from rotating relative thereto, said mutually oriented holding magnets comprising at least a first holding magnet and at least a second holding magnet magnetically cooperating with said first holding magnet, said at least one oscillating body being arranged on an end face of said storage body which is disposed on one side of said winding member and faces said winding member, said end face having secured thereto at least said first holding magnet in an area in which said at least one oscillating body has a recess, said second holding magnet which cooperates with said first holding magnet being arranged on the other side of said winding member in said housing.

5. A yarn feeder according to claim 4, wherein said first holding magnet is positioned within said recess of said at least one oscillating body by means of a soft-iron carrier, said at least one oscillating body filing said interspace to a large extent approximately with the axial dimensions of said first holding magnet and of said soft-iron carrier, said at least one oscillating body being prevented from rotating on said storage body by means of a rotary coupling having a certain amount of rotational play through which said at least one oscillating body can oscillate, said soft-iron carrier being provided with a safety member extending beyond an edge of said recess.

6. A yarn feeder according to claim 5, wherein said rotary coupling includes a projectionlike engagement member which is a bending spring formed on said end face of said storage body, and a recess, which is provided in said at least one oscillating body and is engaged by said engagement member so as to provide said certain amount of rotational play of said at least one oscillating body relative to said storage body.

7. A yarn feeder according to claim 1, wherein said at least one oscillating body contacts said storage body such that mechanical sliding friction will occur.

8. A yarn feeder according to claim 7, wherein one of a friction lining and a friction element is provided in the area of mutual contact between said at least one oscillating body and said storage body.

9. A yarn feeder according to claim 1, which includes winding means having a winding member for depositing windings of yarn on said storage drum during operation, said storage body including insert members for the separation of said yarn windings which have been deposited on said storage body by means of said winding member, said damping mass of said at least one oscillating body corresponding approximately to the mass of said storage body plus said insert members.

10. A yarn feeder according to claim 1, wherein said at least one oscillating body is disposed in an interior of said storage body.

11. A yarn feeder according to claim 1, wherein said at least one oscillating body is secured to said storage body by a plastically deformable layer, said damping connection being provided by said plastically deformable layer which is a material with high internal friction in the case of deformation.

12. A yarn feeder according to claim 1, wherein said storage body includes a receptacle and said at least one oscillating body is a filling which consists of bodies of a heavy, solid material, said bodies being arranged in said receptacle.

13. A yarn feeder according to claim 12, wherein a displaceable, plastically deformable material having a high internal friction is provided in said receptacle as an additional filling, said material being one of a liquid, a paste-like substance, a granulate and a powder.

14. A yarn feeder according to claim 13, wherein at least a portion of said at least one oscillating body is spaced from an interior surface of said receptacle so as to define at least one throttle passage which permits said filling to be displaced through said at least one throttle passage by said at least one oscillating body during movement of said at least one oscillating body relative to said storage body.

15. A yarn feeder according to claim 1, wherein said storage body includes a cavity and said at least one oscillating body comprises at least one inserted weight movably disposed in said cavity.

16. A yarn feeder according to claim 1, wherein said at least one oscillating body is pivotally mounted on said storage body.

17. A yarn feeder comprising:

a housing defining a housing chamber;

a rotatable drive shaft extending into said housing chamber and being rotatable about a rotation axis during operation of said yarn feeder;

a yarn feeding arm secured to said drive shaft so as to rotate about said rotation axis as said drive shaft rotates for winding yarn about said storage body;

a nonrotating storage body having support means for rotatably supporting said storage body on said shaft such that said shaft rotates freely with respect to said storage body, said storage body being free of structural connection with said housing;

mutually oriented holding magnets comprising a first said holding magnet disposed on said housing and a second said holding magnet disposed on said storage body proximate said first holding magnet so that rotation of said storage body is limited to oscillating movement about said rotation axis during rotation of said shaft;

said storage body including at least one oscillating body which acts as a damping mass for damping oscillating movement of said storage body, and securing means for securing said oscillating body to said storage body such that said oscillating body is movable relative to said storage body about said rotational axis; and a damping connection provided between said storage body and said oscillating body such that oscillating movement of said storage body is damped by counteracting oscillating movement of said oscillating body relative to said storage body.

18. A yarn feeder according to claim 17, wherein said oscillating body and said storage body have respective opposing contact surfaces frictionally cooperating one with the other such that frictional sliding contact occurs during oscillating movement of said oscillating body relative to said storage body.

19. A yarn feeder according to claim 17, wherein oscillating movement of said storage body is transmitted to said oscillating body through said damping connection therebetween so as to cause said movement of said oscillating body relative to said storage body.

* * * * *